US007429069B2

(12) United States Patent
Kellinghaus

(10) Patent No.: US 7,429,069 B2
(45) Date of Patent: Sep. 30, 2008

(54) SHAPED MOULDING STRIP

(75) Inventor: Robert Kellinghaus, Mettingen (DE)

(73) Assignee: PUR Mobelprofile-Vertriebs GmbH (DE)

( * ) Notice: Subject to any disclaimer, the term of this patent is extended or adjusted under 35 U.S.C. 154(b) by 82 days.

(21) Appl. No.: 11/472,752

(22) Filed: Jun. 22, 2006

(65) Prior Publication Data

US 2007/0182203 A1 Aug. 9, 2007

(30) Foreign Application Priority Data

Nov. 26, 2005 (DE) ..... 10 2005 056 439

(51) Int. Cl.
*B60R 13/01* (2006.01)

(52) U.S. Cl. ..... 296/39.1 B; 296/1.08; 296/210

(58) Field of Classification Search ..... 296/39.1, 296/1.08

See application file for complete search history.

(56) References Cited

U.S. PATENT DOCUMENTS 2,521,271 A * 9/1950 Wiley ..... 24/295
2,931,119 A * 4/1960 Gits et al. ..... 428/66.5
3,436,297 A * 4/1969 Brooks et al. ..... 293/120
4,505,965 A * 3/1985 Zipperle ..... 428/122
4,579,755 A * 4/1986 Takeda et al. ..... 293/102
5,013,083 A * 5/1991 Yada et al. ..... 296/213
5,437,131 A * 8/1995 Tamura ..... 296/84.1
5,639,522 A * 6/1997 Maki et al. ..... 293/128
6,210,615 B1 * 4/2001 Yoshizuru et al. ..... 264/138
6,709,048 B2 * 3/2004 Nagashima et al. ..... 296/210
6,955,395 B2 * 10/2005 Oshina et al. ..... 296/214
7,004,535 B1 * 2/2006 Osterberg et al. ..... 296/203.03
7,045,189 B2 * 5/2006 Hui et al. ..... 296/210

* cited by examiner

*Primary Examiner*—Kiran B. Patel
(74) *Attorney, Agent, or Firm*—Bourque and Associates

(57) ABSTRACT

A shaped molding strip for use in interior decorating, and an assembly including such a shaped molding strip. Such a molding strip used as a so-called transition strip possesses a mushroom-shaped cross section with a projecting attachment spar on its inner side and roof spars that include a convex arch or acute-angle angled area on their exterior. For the purpose of altering the strip shape, at least one intentional breaking point is shaped at least in the area of the carrier material forming the roof spars within its core. This forms a breakaway end section in the roof spar. A molding kit including the shaped molding includes adhesive to reinforce at least one slot in the core material of the pertinent roof spar that remains not broken off from the adjacent roof spar section in the installed position of the molding strip. Sandpaper may also be provided to finish the adhered molding piece.

8 Claims, 2 Drawing Sheets

SHAPED MOULDING STRIP

TECHNICAL FIELD

The present invention relates to a shaped molding strip for use in interior decorating, and to a kit including such a shaped molding strip

BACKGROUND INFORMATION

The invention relates to a molding strip and on a molding strip kit

Such a molding strip may find many applications in interior decorating. Such a molding strip is required to cover a transition area between different floor coverings, or in general as a terminal connection or expansion joint strip. Conventional implementations of molding strips provided for this purpose vary accordingly. Depending on the height difference to be compensated, molding strips are used whose roof spars possess varying angles or arches, and may possess varying lengths. Attachment of the molding strips is to securing rails mounted to the floor, wall, or ceiling. The molding strip is snapped into the securing rail by means of the attachment spars. These securing rails and molding strips are often offered to the interior decorator with necessary fasteners as a kit. For this, several molding strips combinable with the same securing rail are provided, and the unused molding strips must be discarded.

SUMMARY

It is the task of the invention to provide a molding strip of the type mentioned at the outset whose cross-sectional shape may be altered in order to cover two or more molding strips in addition to the initial molding strip with a single strip.

The cross-sectional shape of the molding strip according to the present invention should be alterable by breaking off the end section of one or both roof spars, whereby numerous combinations may result in order to achieve a specific cross-sectional molding shape. One may select four configuration options with a molding strip in which an end section may be broken off of either of the roof spars in that none, either one, or two end sections may be broken off. Considerable advantages to reduce logistics costs both for the manufacturer and for wholesale or specialized dealers arise from the corresponding savings, since one must deal with only one molding strip with the desired shape instead of with three or four various molding strips. The end user of the molding strip based on the invention has the option of modifying the molding strip to the application on-site where he may select between shape options to the extent allowed by the application. He does not require a single tool to perform the required shape modification.

BRIEF DESCRIPTION OF THE DRAWINGS

These and other features and advantages of the present invention will be better understood by reading the following detailed description, taken together with the drawings wherein:

FIG. 1 shows in detail the carrier material 1 with mushroom-shaped cross section that may consist of wood-chip or fiber material such as plywood or medium-density fiberboard, plastic, metal, or a composite of these materials. An attachment spar 2 formed of the carrier material 1 is provided on the inner side of the molding strip covered when the molding strip is installed that extends the entire length of the molding strip. Longitudinal roof spars 3, 5 that include the same carrier material 1 as the attachment spar 2 and adjoin the attachment spar 2 at its upper end. Depending on the carrier material 1, the core of the molding strip thus formed may be made of one or two pieces. For two pieces, it may be provided that the strip core consists of plastic material and the separately manufactured attachment spar 2 is firmly joined to the roof spars 3, 5.

Figure 1:
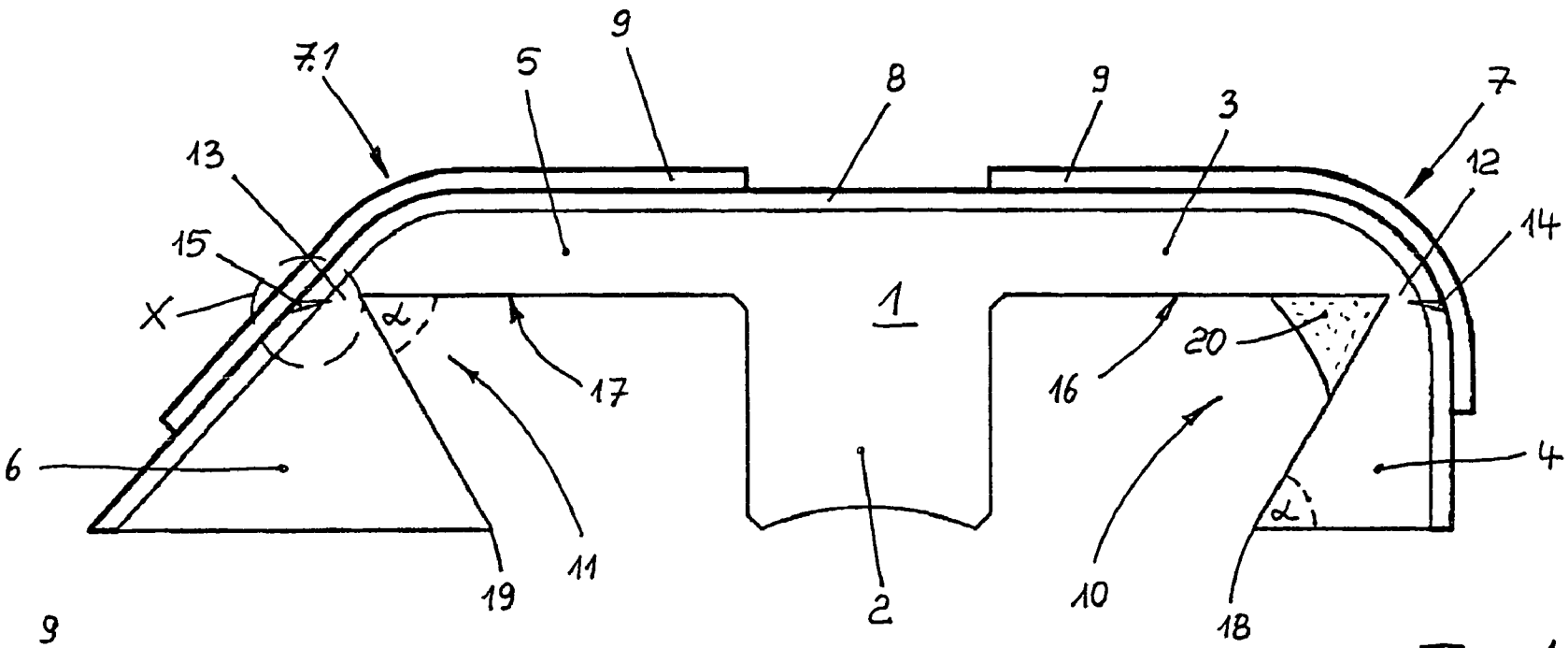
FIG. 1 is a cross section of a molding strip in its initial configuration.

Both roof spars 3 and 5 include end sections 4 and 6 with a particular cross section, which will be subsequently described in greater detail. A convex arch 7, 7.1 or a corresponding acute-angle angled section is provided in the transition section between the roof spars 3, 5 and the roof spar end sections 4, 6 on the outer side of the molding strip. Depending on the configuration of these arches or angled sections 7, 7.1, strip flanks that increase variously, or that are oblique longitudinally, may be provided that match the application of the molding strip. The carrier material 1 of the strip core is decorated with a décor layer over the entire length of the upper side of the roof spars 3, 5 and of their end sections 4, 6. This may involve a film, a veneer, or a laminated covering. Further, FIG. 1 also shows a removable film 9 over the arches 7, 7.1 on the decorative layer 8 that is removed at the latest after successful installation of the molding strip.

Slots 10, 11 that possess a V-shaped cross section are cut into the carrier material forming the roof spars 3, 5 from the inner side of the molding strip. The faces of these acute-angle slots 10, 11 extend almost to the side of the carrier material facing the outer side of the molding strip and are covered by the decorative layer 8 so that intentional breakaway points 12, 13 are formed in approximate continuation of the half-angle of the V angle of the slots 10, 11 by means of which the core of the roof spar end sections 4, 6 are still in connection with the core of the roof spars 3, 5 in the final shape of the molding strip of the core. Cutouts 14, 15 should be provided in the decorative layer 8 in the direction of the intentional breakaway points 12, 13 by means of which the decorative layer 8 is completely divided. The cutouts 13, 14 may extend into the carrier material 1 in the area of the breakaway spars 12, 13 as FIG. 1*a* shows. The depth of the cutouts 14, 15 is determined based on the material selected for the decorative layer 8. For brittle materials that may be cleanly broken, as may be the case with veneers, the cutouts 14, 15 may be merely slits through the decorative layer 8.

In order to compensate for the weakened material in the area of the breakaway spars 12, 13 during handling and transport of the finished molding strip, the above-mentioned removable film 9 is provided on the outer side of the molding strip on the decorative layer 8. This removable film 9 extends over the apertures of the cutouts 14, 15 that are so fine (i.e., are implemented with such a small cross section) that they are not noticeable when the removable film 9 is removed when the molding strip is in its installed position. The removable film 9 further serves to support a clean break when the pertinent roof spar end sections 4, 6 are broken off. The film acts as a film hinge in the area of the break line, and the section remaining may be pulled off from each roof spar 3, 5 after successful breaking by means of the section still adhering to the pertinent roof spar end section 4, 6.

The cutouts 14, 15, as well as the breakaway spars 12, 13 lie on the side of the facing the end sections 4, 6 of the roof spars 3, 5 with respect to the arches or angled sections 7, 7.1. Moreover, the cutouts 14, 15 are displaced even farther toward the roof spar end sections 4, 6 in relation to the breakaway spars 12, 13 so that, when the end sections 4, 6 are broken off, the exposed cut surfaces 23, 24 up to the cutouts 14, 15 of the decorative layer 8 when the molding strip is in installed position have secure contact with the opposing surface of the floor, wall, or the covering.

Figure 1A:
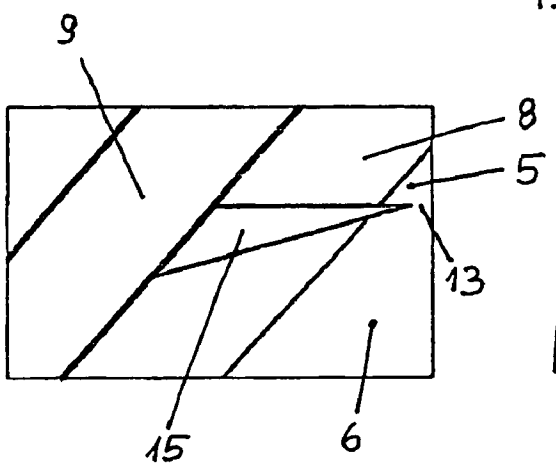
FIG. 1*a* is an enlarged, detailed view of the molding strip at "X" in FIG. 1.

The molding strip may be used with the cross section as shown by FIG. 1. By breaking off one or both of the roof spar end sections 4, 6, molding strip shape configurations may be achieved, as FIGS. 2-4 show.

Figure 2:
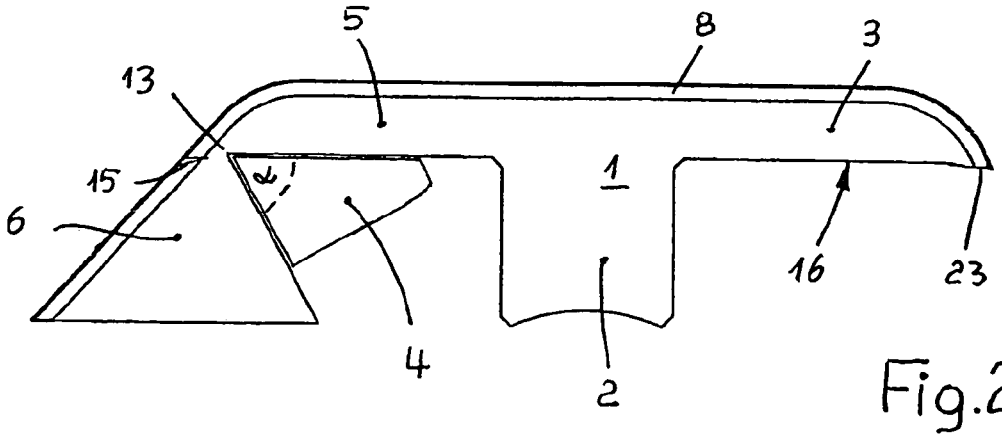
FIGS. 2-4 are cross-sectional views of the molding strips obtainable from the cross-section shown in FIG. 1.

Thus, the cross-section option in FIG. 2 shows a molding strip in which the end section 4 of one roof spar is broken off. The strip-shaped end section 4 may be used to reinforce the molding strip along the opposing longitudinal side in the area of the breakaway spar 13 still present between the roof spar 5 and its end section 6. One of the edges, namely the free edge 18 in the finished version of the roof spar end section 4, possesses an edge angle ($\alpha$) equal to the V-angle of the slot 11 on the opposing longitudinal side of the strip, as FIG. 1 shows. Thus, as FIG. 2 shows, the strip-shaped end section 4 may be glued in place in the gusset between the roof spar 5 and its end section 6, as FIG. 2 shows.

An adhesive 20 may alternatively be inserted into the above-mentioned gusset that possesses adequate stiffness when cured. FIG. 1 shows this in the gusset area between the roof spar 3 and its end section 4.

Figure 3:
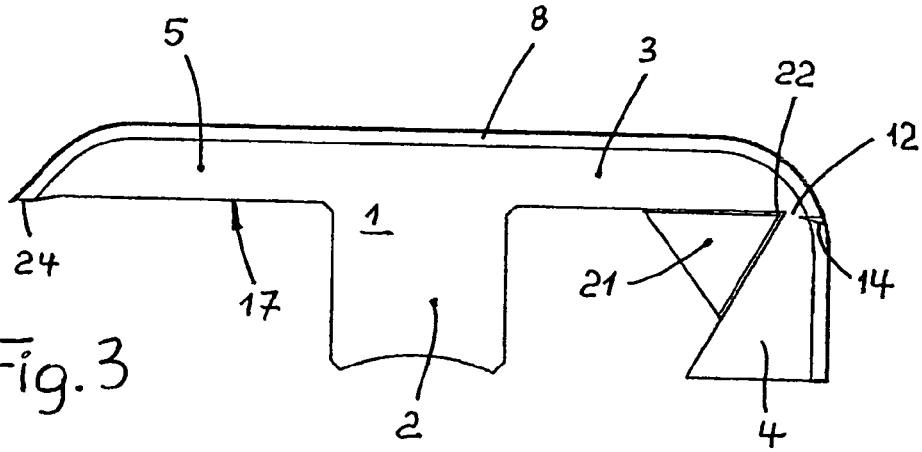
Figure 4:
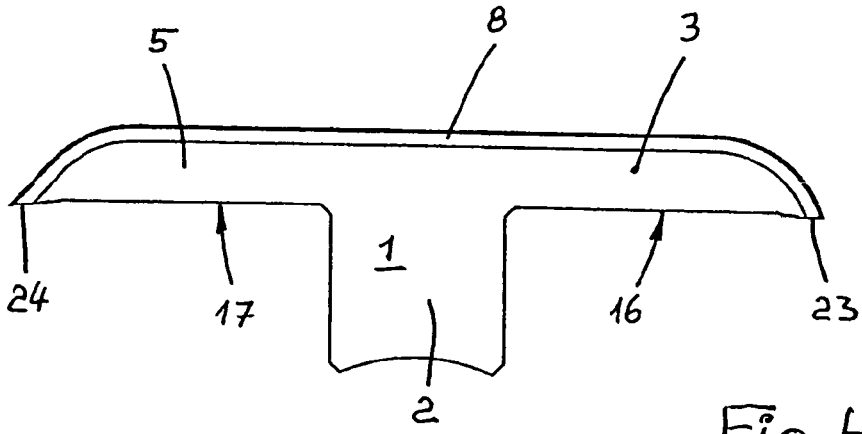

Further, a separate reinforcement strip 21 may be provided that stabilizes the particular roof spar end section 4 or 6 when the molding strip is in its installed position, as FIG. 3 shows. This dedicated reinforcement strip 21 possesses an edge 22 whose edge angle corresponds to the V-angle of the pertinent slot 10, 11. The molding strip including the reinforcement strip 21 and/or the adhesive 20 may be combined with the necessary securing strip as a kit as necessary in order to provide the user with everything required for the production and installation of the pertinent strip shape. Sandpaper with which the break surface of the breakaway spars 12, 13 may be smoothed may be included in the kit.

FIG. 4 shows a cross section of the molding strip for the case in which the end sections of both roof spars may be eliminated by being broken off. Just as in FIG. 4, it may result from FIGS. 2 and 3 that when the roof spar end sections 4, 6 are broken off, the cut surfaces 23, 24 in the area of the cutouts 14, 15 of the decorative layer 8 on the securing side of the molding strip project over the flat inner sides 16, 17 of the roof spar 3, 5 in the direction of attachment. The inner sides 16, 17 of the roof spars 3, 5 are formed by a flank of the slot 10, 11, and extend advantageously in a common plane.

Modifications and substitutions by one of ordinary skill in the art are considered to be within the scope of the present invention, which is not to be limited except by the following claims.

The invention claimed is:

1. A molding strip for use in interior decorating at transition areas between floor and/or wall coverings and/or ceiling coverings and having a mushroom-shaped cross-section and a corresponding attachment spar (2) projecting on an inner side of said molding strip and extending longitudinally, as well as roof spars (3, 5) that adjoin the attraction spar (2) longitudinally on both sides and that possess at least one exterior (convex) arched or angle section (7, 7.1), whereby the attachment spar (2) and the roof spars (3, 5) possess a common core of carrier material (1), and the roof spars (3, 5) are provided with a decorative layer (8) on their exterior sides, characterized in that a breakaway spar (12, 13), extending longitudinally is formed into the carrier material (1) at least in the area of the roof spars (3, 5), and herein the decorative layer (8) includes a cutout formed its exterior side extending along the breakaway spar (12, 13), whereby a breakaway end section (4, 6) is formed on the roof spar (3, 5), and that the exterior of the roof spar (3, 5) is covered with removable film (9), extending over the cutout (14, 15) into the decorative layer (8).

2. A molding strip as in claim 1, characterized in that the breakaway spar (12, 13) in the core material (1) and the cutout (14, 15) in the decorative layer (8) are located in a section of the roof spar (3, 5) that is located near the arch or angled section (7, 7.1) on the side toward the breakaway end section (4, 6).

3. A molding strip as in claim 2, characterized in that the cutout (14, 15) in the decorative layer (8) is positioned to be displaced further toward the end section (4, 6) of the roof spar (3, 5) than the breakaway spar (12, 13).

4. A molding strip as in claim 1, characterized in that the breakaway spar (12, 13) is formed by a slot (10, 11) cut into the carrier material (1) from the inner side of the strip.

5. A molding strip as in claim 1, characterized in that both roof spars (3 and 5) include breakaway spars (12, 12) whereby the arch or angled section (7) of the first roof spar (3) is implemented differently than the arch or angled section (7, 7.1) of the second roof spar (5).

6. A molding strip as in claim 4, characterized in that each slot (10, 11) in the core material (1) of the pertinent roof spar (3, 5) possesses a V-shaped cross section, whereby the slot flank (16, 17) opposite the breakaway section (4, 6) of the roof spar (3, 5) lies in a plane perpendicular to the central longitudinal plane of the attachment spar (2).

7. A molding strip as in claim 4, characterized in that the breakaway section (4, 6) of the roof spar (3, 5) possesses at least one edge (16, 19) whose edge angle is equal to the V-angle ($\alpha$) of the slot (10, 11) in the carrier material (1) of the roof spar (3, 5).

8. A molding strip as in claim 1, characterized in that the decorative layer (8) of the root spars (3, 5) is divided by a cutout (14, 15).

* * * * *